US009327288B2

(12) United States Patent
Kozawa et al.

(10) Patent No.: US 9,327,288 B2
(45) Date of Patent: May 3, 2016

(54) METHOD OF GRINDING POWDER

(75) Inventors: Kazumi Kozawa, Fujimino (JP); Harutoshi Tominaga, Saitama (JP)

(73) Assignee: NISSHIN ENGINEERING INC., Tokyo (JP)

( * ) Notice: Subject to any disclaimer, the term of this patent is extended or adjusted under 35 U.S.C. 154(b) by 324 days.

(21) Appl. No.: 13/993,148

(22) PCT Filed: Dec. 12, 2011

(86) PCT No.: PCT/JP2011/078651

§ 371 (c)(1),
(2), (4) Date: Jun. 11, 2013

(87) PCT Pub. No.: WO2012/117639

PCT Pub. Date: Sep. 7, 2012

(65) Prior Publication Data

US 2013/0341438 A1 Dec. 26, 2013

(30) Foreign Application Priority Data

Feb. 28, 2011 (JP) ..... 2011-041952

(51) Int. Cl.
*B02C 19/06* (2006.01)
*B02C 23/06* (2006.01)

(52) U.S. Cl.
CPC ..... *B02C 19/06* (2013.01); *B02C 19/061* (2013.01); *B02C 23/06* (2013.01)

(58) Field of Classification Search
CPC .... B02C 19/06; B02C 19/061; B02C 19/063; B02C 19/065
USPC ..... 241/5, 18, 16, 39, 40
See application file for complete search history.

(56) References Cited

U.S. PATENT DOCUMENTS 4,824,030 A 4/1989 Kano et al.
7,905,433 B2 * 3/2011 Pfeffer ..... B01J 8/1818 241/1

(Continued)

FOREIGN PATENT DOCUMENTS

CN 1102837 A 5/1995
CN 101049580 A 10/2007

(Continued)

OTHER PUBLICATIONS

Sep. 3, 2013 International Preliminary Report on Patentability issued in International Application No. PCT/JP2011/078651.

(Continued)

*Primary Examiner* — Faye Francis
(74) *Attorney, Agent, or Firm* — Oliff PLC

(57) ABSTRACT

A method of grinding a powder, which grinds a powder using an air stream generated inside a grinding chamber in a jet mill in which there is no place to retain powder inside the grinding chamber is provided. The method includes: a mixing step of mixing an auxiliary agent with the powder; a heating step of heating a high pressure gas; a supplying step of supplying the high pressure gas heated in the heating step into the grinding chamber; an injecting step of injecting the powder in which the auxiliary agent is mixed in the mixing step into the grinding chamber in a predetermined amount in which the concentration of the auxiliary agent inside the grinding chamber is lower than an ignition concentration; and a grinding step of grinding the powder using the air stream generated inside the grinding chamber by the high pressure gas supplied in the supplying step.

4 Claims, 4 Drawing Sheets

(56) References Cited

U.S. PATENT DOCUMENTS

| | | | | |
|---|---|---|---|---|
| 2008/0029625 | A1* | 2/2008 | Talton | B02C 19/06 241/21 |
| 2008/0283638 | A1* | 11/2008 | Omatsu | B02C 19/066 241/5 |

FOREIGN PATENT DOCUMENTS

| | | | |
|---|---|---|---|
| CN | 201333422 | Y | 10/2009 |
| JP | A-63-072361 | | 4/1988 |
| JP | A-63-151367 | | 6/1988 |
| JP | A-05-330819 | | 12/1993 |
| JP | A-06-254427 | | 9/1994 |
| JP | A-08-119693 | | 5/1996 |
| JP | A-08-155324 | | 6/1996 |
| JP | A-11-179228 | | 7/1999 |
| JP | A-2000-005621 | | 1/2000 |
| JP | A-2000-042441 | | 2/2000 |
| JP | A-2000-140675 | | 5/2000 |
| JP | A-2000-247751 | | 9/2000 |
| JP | A-2003-088773 | | 3/2003 |
| JP | A-2005-131633 | | 5/2005 |
| JP | A-2007-196147 | | 8/2007 |
| JP | A-2008-212904 | | 9/2008 |
| JP | A-2008-259935 | | 10/2008 |
| TW | 201036714 | A1 | 10/2010 |

OTHER PUBLICATIONS

Dec. 16, 2014 Office Action issued in Chinese Application No. 201180056574.5.

Feb. 10, 2015 Office Action issued in Japanese Application No. 2013502156.

Partial Translation of JP S63-151367.

Apr. 27, 2015 Office Action issued in Taiwanese Application No. 100147595.

Supplemental Partial Translation of JP63-151367 A.

Office Action issued in Chinese Patent Application No. 201180056574.5 dated May 29, 2014 (with translation).

International Search Report issued in International Application No. PCT/JP2011/078651 dated Feb. 21, 2012.

* cited by examiner

METHOD OF GRINDING POWDER

TECHNICAL FIELD

The present invention relates to a method of grinding a powder, with the use of a grinding apparatus which grinds a powder using an air stream generated inside a grinding chamber.

BACKGROUND ART

In the past, there have been grinding apparatuses using a wide variety of principles. Among these, there are grinding apparatuses employing a system which uses an air stream, which are referred to as jet mills, and these have various mechanisms. For example, jet mills, which combine a grinding mechanism, in which powders are made to collide with each other by using the collision of opposing streams of jet air, and a classification mechanism, are referred to as fluidized bed type jet mills (refer to Patent Literatures 1 to 3).

In addition, there are cyclonic air stream type jet mills generating a cyclonic air stream inside a grinding chamber by jetting compressed air from ejection nozzles arranged on a side wall of the grinding chamber to be inclined with respect to a center portion of the grinding chamber, and grinding powders injected inside the grinding chamber using this cyclonic air stream (refer to Patent Literatures 4 to 8), and jet-o-mills grinding by ejecting high speed air from a bottom portion of a casing shaped like a vertically long doughnut to form a high speed cyclonic air stream inside a grinding chamber of a casing body, and putting the powders into the cyclonic air stream so as to collide with each other (refer to Patent Literature 9).

Furthermore, a collision type jet mill carries and accelerates the powder in a jet stream so as to cause a collision with a collision member, and grinds the powder by the force of the impact (refer to Patent Literatures 10 and 11), and a current jet mill is provided with a grinding zone and a classification zone by forming a partition wall in an oval shaped inner space, and has a structure in which nozzles blowing a jet stream are arranged in the grinding zone (refer to Patent Literature 12).

CITATION LIST

Patent Literature

{PTL 1} Japanese Unexamined Patent Application Publication No. 2003-88773

{PTL 2} Japanese Unexamined Patent Application Publication No. 2008-259935

{PTL 3} Japanese Unexamined Patent Application Publication No. 2000-5621

{PTL 4} Japanese Unexamined Patent Application Publication No. 2000-42441

{PTL 5} Japanese Unexamined Patent Application Publication No. 2007-196147

{PTL 6} Japanese Unexamined Patent Application Publication No. H11-179228

{PTL 7} Japanese Unexamined Patent Application Publication No. H6-254427

{PTL 8} Japanese Unexamined Patent Application Publication No. 2005-131633

{PTL 9} Japanese Unexamined Patent Application Publication No. 2008-212904

{PTL 10} Japanese Unexamined Patent Application Publication No. H8-155324

{PTL 11} Japanese Unexamined Patent Application Publication No. 2000-140675

{PTL 12} Japanese Unexamined Patent Application Publication No. S63-72361

SUMMARY OF INVENTION

Technical Problem

In a case where a powder with high adhesiveness is ground in the grinding apparatuses as described above, there have been problems such as that the powder is adhered and deposited inside the apparatus whereby an obstruction is generated inside the apparatus, or that the deposited matter is peeled off and aggregations of powder are discharged. As the result of repeated intensive research, the present inventors have conceived of a method of grinding a powder capable of being favorably used in a jet mill in which there is no place to retain powder inside the grinding chamber, thereby completing the present invention. That is, an object of the present invention is to provide a method of grinding a powder with which it is possible to grind powder more finely in a jet mill in which there is no place to retain powder inside the grinding chamber and possible to grind powder continuously. Here, the jet mill in which there is no place to retain powder inside the grinding chamber indicates a cyclonic air stream type jet mill, a jet-o-mill, a collision type jet mill, and a current jet mill. On the other hand, a jet mill in which there is a place to retain powder inside the grinding chamber indicates the fluidized bed type jet mill; however, since stagnation of the powder is caused when there is a place to retain powder inside the grinding chamber, the application of the present invention is difficult.

Solution to Problem

The method of grinding powder according to the present invention is a method of grinding a powder which grinds a powder using an air stream generated inside a grinding chamber in a jet mill in which there is no place to retain powder inside the grinding chamber, and the method includes: a mixing step of mixing an auxiliary agent with the powder; a heating step of heating a high pressure gas; a supplying step of supplying the high pressure gas heated in the heating step into the grinding chamber; an injecting step of injecting the powder in which the auxiliary agent is mixed in the mixing step into the grinding chamber in a predetermined amount in which the concentration of the auxiliary agent inside the grinding chamber is lower than an ignition concentration; and a grinding step of grinding the powder using the air stream generated inside the grinding chamber by the high pressure gas supplied in the supplying step.

In addition, in the method of grinding powder of the present invention, the heating step is characterized by heating the high pressure gas such that a temperature inside the grinding chamber reaches an ignition point of the auxiliary agent or more and 200° C. or less.

In addition, in the method of grinding powder of the present invention, the auxiliary agent is characterized by being alcohols or glycol ethers.

Advantageous Effects of Invention

According to the present invention, using a jet mill in which there is no place to retain powder inside the grinding chamber, it is possible to grind powder more finely and it is possible to grind powder continuously.

DESCRIPTION OF EMBODIMENTS

Figure 1:
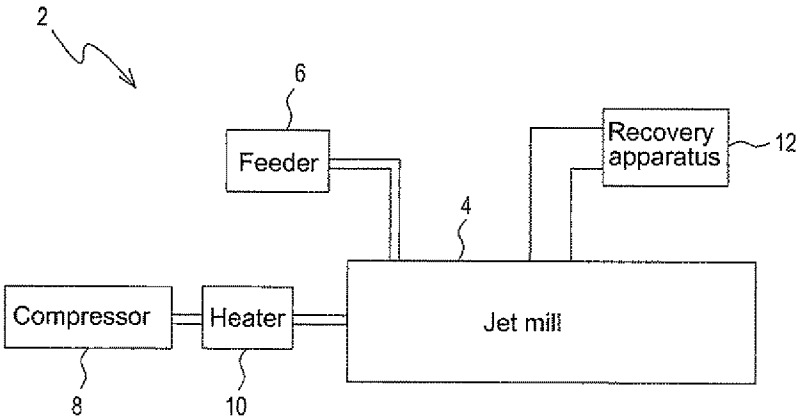
FIG. 1 view showing a configuration of a grinding apparatus according to an embodiment of the present invention.

Hereinbelow, description will be given of a method of grinding a powder according to an embodiment of the present invention with reference to the drawings. FIG. 1 is a view showing a configuration of a grinding apparatus used in the method of grinding the powder according to the embodiment.

As shown in FIG. 1, a grinding apparatus 2 is provided with a jet mill 4 which grinds an injected powder using an air stream generated in the interior of a grinding chamber 20 (refer to FIG. 2), a feeder 6 which injects the powder into the jet mill 4, a compressor 8 which supplies high pressure gas to the jet mill 4, a heater 10 which heats the supplied high pressure gas up to a predetermined temperature, and a recovery apparatus 12 which recovers the powder discharged from the jet mill 4.

The feeder 6 has a screw (not shown) in the interior and quantitatively sends out the powder accommodated in the interior by rotating the screw. The sent out powder is injected into a hopper 36 (refer to FIG. 2) provided on an upper surface of the jet mill 4 and supplied to the grinding chamber 20 of the jet mill 4. Here, the powder accommodated inside the feeder 6 is mixed in advance with an auxiliary agent which will be described later.

The compressor 8 compresses air so as to generate a high pressure gas, and supplies the high pressure gas to the grinding chamber 20 of the jet mill 4 through the heater 10. The interior of the heater 10 has piping through which the high pressure gas passes. Inside the piping, heating means formed of a filament, an aerofin, or the like is arranged. This heating means heats the high pressure gas passing inside the piping up to a predetermined temperature and, along with this, removes the moisture contained in the high pressure gas. Here, between the compressor 8 and the jet mill 4, other dehydration means removing moisture included in the high pressure gas may be provided separately, or a filter removing dust and the like may be appropriately provided.

The recovery apparatus 12 collects and recovers the finely ground powder discharged along with the air stream from an outlet pipe 30 (refer to FIG. 2) provided in the center of the upper surface of the jet mill 4, using a cyclone or bag filter or the like.

Figure 2:
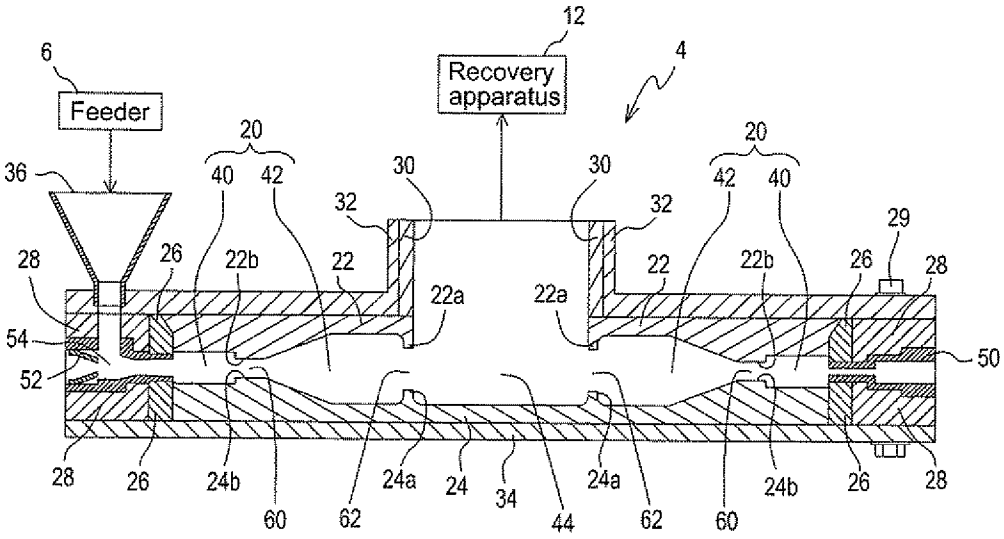
FIG. 2 A vertical cross-sectional view showing a configuration of the interior of a jet mill according to an embodiment of the present invention.
Figure 3:
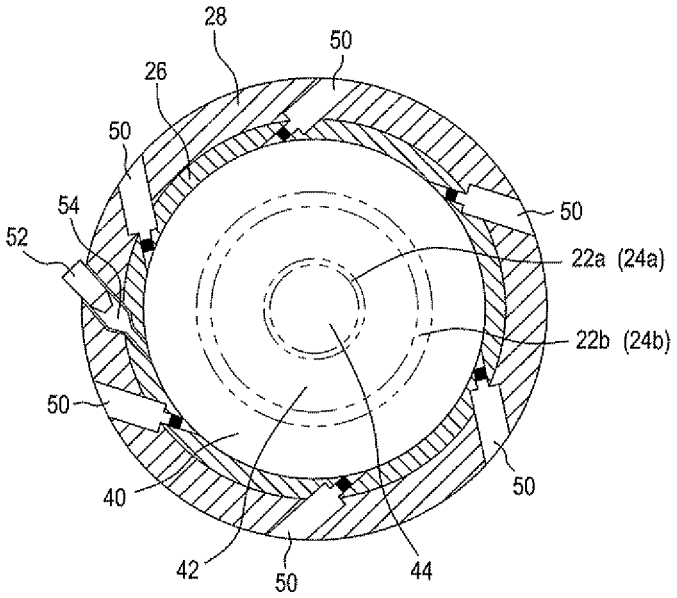
FIG. 3 A transverse cross-sectional view showing an arrangement state of air nozzles and supply nozzles in an outer wall support ring according to an embodiment of the present invention.

Next, with reference to FIG. 2 and FIG. 3, description will be given of the configuration of the jet mill 4 according to the present embodiment. FIG. 2 is a vertical cross-sectional view according to a surface including a central axis of the jet mill 4, and FIG. 3 is a transverse cross-sectional view showing an arrangement state of air nozzles and supply nozzles in an outer wall support ring.

The jet mill 4 shown in FIG. 2 has a disk-shaped upper disk member 22 and a lower disk member 24, and the grinding chamber 20 is formed between the upper disk member 22 and the lower disk member 24. A cylindrical grinding ring 26 is arranged on the outer surface of the upper disk member 22 and the lower disk member 24, and an outer wall support ring 28 supporting the grinding ring 26 from outside is also arranged thereon. The cylindrical outlet pipe 30 communicating with the grinding chamber 20 is provided in the central portion of the upper surface of the upper disk member 22, and the conical hopper 36 into which powder sent out from the feeder 6 is injected is provided in the vicinity of an edge portion of the upper surface of the upper disk member 22.

An upper support plate 32 supporting the upper disk member 22, the grinding ring 26, the outer wall support ring 28, and the outlet pipe 30 from the upper side is provided on the upper surface of the upper disk member 22, and a lower support plate 34 supporting the lower disk member 24, the grinding ring 26, and the outer wall support ring 28 from the lower side is provided on the lower surface of the lower disk member 24. Here, the upper support plate 32 and the lower support plate 34 are fixed with a fastener 29 in a state where the upper disk member 22, the lower disk member 24, the grinding ring 26, and the outer wall support ring 28 are sandwiched.

The grinding chamber 20 is formed as a disk-shaped cavity (inner space) surrounded by the upper disk member 22, the lower disk member 24, and the grinding ring 26. The grinding chamber 20 is divided into a ring-shaped grinding zone 40 on the outside and a ring-shaped classification zone 42 on the inside. The grinding zone 40 and the classification zone 42 communicate using a classification ring channel 60 formed as a space between a ring-shaped classification ring 22*b* formed on the lower surface of the upper disk member 22 and a ring-shaped classification ring 24*b* formed at a position corresponding to the classification ring 22*b* on the upper surface of the lower disk member 24.

Below the outlet pipe 30 of the classification zone 42, an outlet space 44 is formed. The classification zone 42 and the outlet space 44 communicate using an outlet ring channel 62 formed as a space between a ring-shaped classification ring 22*a* formed on the lower surface of the upper disk member 22 and a ring-shaped classification ring 24*a* formed at a position corresponding to the classification ring 22*a* on the upper surface of the lower disk member 24.

The grinding zone 40 is a ring-shaped cavity having a constant cavity width along the radius direction. The classification zone 42 is a cavity in which the cavity width is gradually increased toward the center from the outside, and in which the cavity width becomes constant from the middle. Here, the constant cavity width of the classification zone 42 is larger than the cavity width of the grinding zone 40.

As shown in FIG. 3, on the outer wall support ring 28, six air nozzles 50 which jet high pressure gas supplied from the compressor 8 and heated by the heater 10 are provided at equal intervals to be inclined with respect to a tangential line (or a center line) of the outer wall of the outer wall support ring 28. In addition, on the outer wall support ring 28, a supply nozzle 52 which jet heated air in order to send out the powder supplied from the feeder 6 into the grinding chamber 20 is provided to be inclined at approximately the same angle as the air nozzles 50. At the front portion of the supply nozzle 52, a diffuser 54 which supplies the powder supplied from the hopper 36, with being mixed with air jetted from the supply nozzles 52, into the grinding zone 40 of the grinding chamber 20 is provided.

Here, in the jet mill 4, the powder is put in the high speed air stream and makes contact with or collides with respect to the upper disk member 22, the lower disk member 24, the grinding ring 26, the outlet pipe 30, and the distal ends of the air nozzles 50 and the supply nozzle 52. Therefore, it is preferable that these be manufactured using hard ceramics such as SiAlONs.

Figure 4:
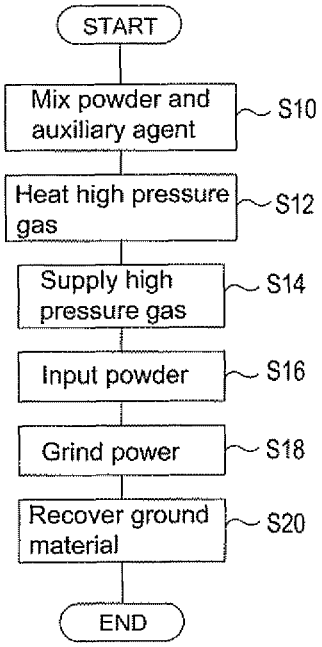
FIG. 4 A flowchart showing a grinding method using a grinding apparatus according to an embodiment of the present invention.

Next, with reference to the flowchart of FIG. 4, description will be given of the method of grinding a powder according to the present embodiment. First, to start, the powder to be ground and the alcohol auxiliary agent or the glycol ether auxiliary agent is mixed (step S10). Here, the type of the auxiliary agent made from alcohols or the auxiliary agent made from glycol ethers to be used may be appropriately selected according to the type of powder. Examples of the alcohols include methanol, ethanol, isopropyl alcohol, and butanol, and examples of the glycol ethers include diethylene glycol monomethyl ether, diethylene glycol dimethyl ether, propylene glycol monomethyl ether, and methoxy methyl butanol. The ignition points of these auxiliary agents are all 93° C. or less. In addition, regarding the adding amount and the mixing method of the auxiliary agents, appropriate selection may be made according to the type of the powder; however, mixing is performed using a mixer after the auxiliary agent is added in a predetermined amount with respect to the powder to be ground. Here, since a part of the auxiliary agent which is added to the powder is evaporated during and after mixing with the powder, the content of the auxiliary agent when the powder is injected to the feeder 6 of the grinding apparatus 2 is less than the adding amount of the auxiliary agent. Here, as the mixer, a precision powder mixing machine Hi-X (manufactured by Nisshin Engineering Inc.) is used.

When the grinding apparatus 2 is operated, the high pressure gas, generated by the compressor 8, at a predetermined pressure is heated to a predetermined temperature by the heater 10 (step S12).

The heater 10 heats the high pressure gas up to approximately 150° C. such that the outlet temperature of the grinding chamber 20 becomes approximately 95° C. When the temperature is higher than the ignition point of the auxiliary agent added to the powder, there is a danger of the possibility of ignition; however, for the reasons described below, ignition does not occur.

The high pressure gas heated up to a predetermined temperature is jetted from the six air nozzles 50 provided in the outer wall support ring 28 and supplied into the grinding chamber (step S14). In this manner, inside the grinding chamber, a high speed cyclonic air stream is generated.

In the above manner, when a state is formed in which a heated high speed cyclonic air stream is regularly rotated inside the grinding chamber 20, the powder in which the auxiliary agent is mixed is sent out quantitatively from the feeder 6, and injected into the grinding chamber 20 through the hopper 36 and the diffuser 54 (step S16). Here, the injection amount of the powder in which the auxiliary agent is mixed is set to an amount at which the concentration of the auxiliary agent inside the grinding chamber 20 does not reach the ignition concentration. Under the condition that the concentration of the auxiliary agent inside the grinding chamber 20 does not reach the ignition concentration, even when the temperature of the high speed cyclonic air stream is a temperature exceeding the ignition point of the auxiliary agent, there is no danger of ignition. Here, the amount at which the concentration of the auxiliary agent inside the grinding chamber 20 does not reach the ignition concentration is determined in consideration of the size of the grinding chamber 20, the pressure of the high pressure gas jetted from the air nozzles 50, the amount of the high pressure gas, and the like.

Since the powder injected into the grinding chamber 20 from the diffuser 54 is instantly diffused inside the grinding chamber 20 by the high speed cyclonic air stream, it is possible to keep the concentration of the auxiliary agent in all portions inside the grinding chamber 20 at the ignition concentration or less without it being possible for powder to gather inside the grinding chamber 20 and partially increase the concentration of the auxiliary agent. However, in a case where a fluidized bed jet mill is used instead of the cyclonic air stream type jet mill shown in FIG. 2, for the inner structure, since stagnation of the powder is caused when there is a place to retain powder inside the grinding chamber, it is not possible to keep the concentration of the auxiliary agent in all portions inside the grinding chamber at the ignition concentration or less and a fair number of portions in which the concentration of the auxiliary agent is high are generated, whereby there is an accompanying danger of ignition or explosion.

The dispersion of the powder injected inside the grinding chamber 20 is promoted by rapidly vaporizing the auxiliary agent present between the fine particles of the powder. The powders dispersed as fine particle units in this manner are rotated inside the grinding chamber 20 without attaching to the surfaces of the upper disk member 22, the lower disk member 24, or the like configuring the grinding chamber 20, and the powders collide with each other or with the inner wall surface of the grinding zone 40 to be ground into fine powder (step S18). In such a case, since the amount of powder injected in the grinding chamber 20 is set to an amount at which the concentration of the auxiliary agent does not reach ignition concentration, even when static electricity is generated by the powder colliding with other powder or the wall surface of the grinding chamber 20, the auxiliary agent is not ignited. On the other hand, in cases using a fluidized bed jet mill, for the same reason as described above, there is a danger that ignition will occur in the auxiliary agent if static electricity is generated.

Then, the fine powder ground to a predetermined grain size is made to float by being put in an air stream rotating in the interior of the grinding chamber 20, passes through the classification ring channel 60 from the grinding zone 40, and flows into the classification zone 42 of the grinding chamber 20. At this time, powder with coarse particles remains in the grinding zone 40 since the centrifugal force generated by the rotating air stream is large, and only the fine powder ground to a predetermined grain size or less passes through the classification ring channel 60 and flows into the classification zone 42. The fine powder having flowed into the classification zone 42 is made to float by being put in an air stream which rotates in the classification zone 40 and which is more streamlined than the grinding zone 42, the powder with coarse particles is left, sorted using a predetermined grain size distribution, passed through the outlet ring channel 62, discharged from the outlet space 44 through the outlet pipe 30, and recovered by the recovery apparatus 12 (step S20). Here, since the added auxiliary agent is all vaporized, it is not included in the recovered powder.

According to the method of grinding a powder according to the embodiment, since the powder to be ground is injected inside the grinding chamber 20 of the jet mill 4 with being mixed with the auxiliary agent and, along with this, a high-temperature high speed cyclonic air stream is formed inside the grinding chamber 20 by the heated high pressure gas, it is possible to grind into fine particles and to continuously obtain a finely ground powder.

Here, in this embodiment, the supplied high pressure gas is heated up to approximately 150° C. such that the outlet temperature of the grinding chamber 20 becomes approximately 95° C.; however, this is only one example, and even in a case where the supplied high pressure gas is heated such that the temperature of the cyclonic air stream inside the grinding chamber 20 becomes the ignition point of the auxiliary agent mixed with the powder or more and 200° C. or less, the same effects are exhibited, and it is possible to finely and continuously grind the powder.

In addition, in the embodiment described above, six air nozzles 50 are provided; however, in a case where the powder with low adhesiveness is ground, it is possible to increase the energy of the high pressure gas jetted from one air nozzle 50 and to grind the powder with high efficiency by appropriately selecting four, two, or the like as the number of air nozzles 50.

Here, in the embodiment, a cyclonic air stream type jet mill is used; however, even when a jet-o-mill, a collision type jet mill, or a current jet mill is used, it is possible to grind the powder with high efficiency in the same manner.

EXAMPLES

Next, description will be given of the method of grinding a powder according to examples of the invention by showing specific test results. In the test, a high pressure gas with a pressure of 0.7 MPa and a wind amount of approximately 0.7 $Nm^3$/min was generated by the compressor 8 of FIG. 1 using the grinding apparatus (cyclonic air stream type jet mill) 2 installed with insulation equipment. In addition, in the test, as the powders to be ground, using fine powder of barium titanate (particle size distribution $D_{50}$=0.683 μm (median diameter) and $D_{100}$=7.778 μm (maximum diameter) by volume estimation), (1) powder of only fine powder of barium titanate (no auxiliary agent), (2) powder in which 5% by mass ratio of diethylene glycol monomethyl ether as a glycol ether based auxiliary agent was added and mixed with fine powder of barium titanate (4% by mass ratio immediately before injection into grinding chamber), and (3) powder in which 10% by mass ratio of ethanol as an alcohol based auxiliary agent was added and mixed with fine powder of barium titanate (5% by mass ratio immediately before injection into grinding chamber), were used. Here, the injection of the powder into the jet mill 4 of the grinding apparatus 2 was set to 250 g/hour.

Table 1 shows the result of grinding the fine powder of (1) described above using the grinding apparatus 2 at an outlet temperature of 3° C., the result of grinding the mixed powder of (2) using the grinding apparatus 2 at an outlet temperature of 95° C., and the result of grinding the mixed powder of (3) using the grinding apparatus 2 at an outlet temperature of 95° C.

TABLE 1

| Sample | Outlet temperature | $D_{50}$ | $D_{100}$ | Remarks |
|---|---|---|---|---|
| (1) Barium titanate | 3° C. | — | — | Clogging was generated in diffuser within tens of seconds, which discontinued operation |
| (2) Barium titanate + diethylene glycol monomethyl ether 5% | 95° C. | 0.448 μm | 1.375 μm | Continuous operation possible |
| (3) Barium titanate + Ethanol 10% | 95° C. | 0.472 μm | 1.375 μm | Continuous operation possible |

As shown in Table 1, in the case of (1), the fine powder of barium titanate was attached to the inner surface or the like of the grinding chamber 20 and clogging was generated in the diffuser 54 within tens of seconds, whereby it was not possible to drive the grinding apparatus 2.

In addition, in the case of (2), it was possible to continuously obtain fine powders of finely ground barium titanate without the powder being attached inside the grinding chamber 20 and generating an obstruction in the grinding chamber 20. The particle size distribution of the ground fine powders was $D_{50}$=0.448 μm and $D_{100}$=1.375 μm by volume estimation.

In addition, in the case of (3), it was possible to continuously obtain fine powders of finely ground barium titanate without the powder being attached inside the grinding chamber 20 and generating an obstruction in the grinding chamber 20. The particle size distribution of the ground fine powders was $D_{50}$=0.472 μm and $D_{100}$=1.375 μm by volume estimation.

From the above results, in a case where the fine powder of barium titanate and diethylene glycol monomethyl ether are mixed and in a case where the fine powder of barium titanate and ethanol are nixed, it is possible to continuously perform grinding of the barium titanate and to continuously obtain finely ground powder.

DESCRIPTION OF REFERENCE NUMERALS

2 . . . GRINDING APPARATUS, 4 . . . JET MILL, 6 . . . FEEDER, 8 . . . COMPRESSOR, 10 . . . HEATER, 12 . . . RECOVERY APPARATUS, 20 . . . GRINDING CHAMBER, 22 . . . UPPER DISK MEMBER, 24 . . . LOWER DISK MEMBER, 40 . . . GRINDING ZONE, 42 . . . CLASSIFICATION ZONE, 50 . . . AIR NOZZLE, 52 . . . SUPPLY NOZZLE, 54 . . . DIFFUSER

The invention claimed is:

1. A method of grinding a powder which grinds a powder using an air stream generated inside a grinding chamber in a jet mill in which there is no place to retain powder inside the grinding chamber, the method comprising:

a mixing step of mixing an auxiliary agent with the powder;

a heating step of heating a high pressure gas;

a supplying step of supplying the high pressure gas heated in the heating step into the grinding chamber;

an injecting step of injecting the powder in which the auxiliary agent is mixed in the mixing step into the grinding chamber in a predetermined amount in which a concentration of the auxiliary agent inside the grinding chamber is lower than an ignition concentration; and a grinding step of grinding the powder, which is dispersed as a result of vaporization of the auxiliary agent inside the grinding chamber, using the air stream generated inside the grinding chamber by the high pressure gas supplied in the supplying step, wherein when a state is formed in which the high pressure gas is regularly rotated inside the grinding chamber, the injecting step is performed.

2. The method of grinding a powder according to claim 1, wherein the heating step includes heating the high pressure gas such that a temperature inside the grinding chamber reaches an ignition point of the auxiliary agent or more and 200° C. or less.

3. The method of grinding a powder according to claim 1, wherein the auxiliary agent comprises alcohols or glycol ethers.

4. The method of grinding a powder according to claim 2, wherein the auxiliary agent comprises alcohols or glycol ethers.

* * * * *